United States Patent [19]

Tanaka et al.

[11] 4,097,285

[45] Jun. 27, 1978

[54] DIRECT-POSITIVE PHOTOGRAPHIC SILVER HALIDE EMULSION CONTAINING NOVEL DYE

[75] Inventors: Akira Tanaka; Akio Yoshida, both of Nagaokakyo, Japan

[73] Assignee: Mitsubishi Paper Mills, Ltd., Tokyo, Japan

[21] Appl. No.: 769,570

[22] Filed: Feb. 17, 1977

[51] Int. Cl.[2] ..... G03C 1/16; G03C 1/28

[52] U.S. Cl. ..... 96/132; 96/101; 96/107; 542/434

[58] Field of Search ..... 96/101, 107, 132; 542/434

[56] References Cited

U.S. PATENT DOCUMENTS

| | | | |
|---|---|---|---|
| 1,942,854 | 1/1934 | Brooker | 96/132 |
| 3,865,596 | 2/1975 | Furuya et al. | 96/101 |
| 3,925,085 | 12/1975 | Sato et al. | 96/101 |

*Primary Examiner*—Won H. Louie, Jr.

*Attorney, Agent, or Firm*—Cushman, Darby & Cushman

[57] ABSTRACT

A direct-positive photographic silver halide emulsion which is spectrally sensitized with a cyanine dye in which the position 2 or 4 of a 1,8-naphthyridine ring is joined through the position 2 of a thiazole ring through a methine linkage is disclosed. Said emulsion has no decreasing tendency of the maximum density and shows no color stain due to the remains of the dye. Photographic elements employing such emulsion are also disclosed.

8 Claims, No Drawings

DIRECT-POSITIVE PHOTOGRAPHIC SILVER HALIDE EMULSION CONTAINING NOVEL DYE

BACKGROUND OF THE INVENTION

This invention relates to a direct-positive photographic silver halide emulsion spectrally sensitized with a novel dye.

Generally, a negative image is obtained on developing a normally exposed silver halide photosensitive material. On the other hand, there has been known a reversal phenomenon which is a phenomenon of formation of a positive image on developing a certain silver halide emulsion after exposure. There are several kinds of the reversal phenomena which are called Herschell effect, Villard-effect, solarization and so on. Of these, solarization has been used in order to obtain high-speed direct-positive silver halide photosensitive materials. Solarization is a halide photosensitive materials. Solarization is a phenomenon of the decrease in optical density with the increase in exposure when a photosensitive silver halide material is developed after overexposure to a light which is absorbed by the photosensitive silver halide material. Solarization is also observed in the case of a silver halide photosensitive material which has been adequately fogged either optically or chemically. By using such a sensitive material, a direct-positive image can be formed.

Usual difficulties, frequently encountered when a direct-positive photographic silver halide emulsion is spectrally sensitized, are, for example, decreased inclination of the characteristic curve, decrease in maximum density, re-reversal (a phenomenon of the re-increase in optical density with the increase in exposure after passing through the minimum density), and color stain due to the residual dye.

SUMMARY OF THE INVENTION

An object of this invention is to provide a high-speed direct-positive photographic silver halide emulsion spectrally sensitized by a novel dye.

Another object of this invention is to provide, using a novel dye, a direct-positive photographic silver halide emulsion free from color stain due to the residual dye.

A further object of this invention is to provide, using a novel dye, a direct-positive photographic silver halide emulsion which does not show such a significant decrease in maximum density as is often observed by the addition of a conventional sensitizing dye.

DESCRIPTION OF THE INVENTION AND THE PREFERRED EMBODIMENTS

The aforementioned objects of this invention can be achieved by incorporating in a direct-positive photographic silver halide emulsion at least one novel cyanine dye in which the position 2 or 4 of a 1,8-naphthyridine ring is joined through the position 2 of a thiazole ring through a methine linkage. Of these cyanine dyes, particularly preferred are those represented by the general formula

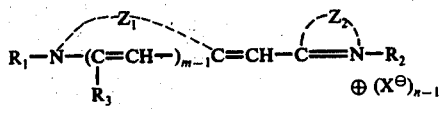

wherein $Z_1$ represents a nonmetallic atom or a group of nonmetallic atoms necessary for completing a 1,8-naphthyridine ring which may have substituent groups such as lower alkyl (methyl, ethyl, propyl, butyl, etc.), lower alkoxy (methoxy, ethoxy, propoxy, butoxy, etc.), acylamido (e.g. acetamido, propionamido, benzamido, etc.), aryl, and halogens; $Z_2$ represents a group of nonmetallic atoms necessary for completing a thiazole ring, benzothiazole ring, or naphthothiazole ring, and these thiazole ring or the benzene ring condensed with thiazole ring may have substituent groups such as lower alkyl, aryl, hydroxyl, lower alkoxy, carboxyl, lower alkoxycarbonyl, nitro, and halogen atoms; $R_1$ and $R_2$ each represents a substituted or unsubstituted lower alkyl group (for example, methyl, ethyl, n-propyl, isopropyl, n-butyl, n-pentyl, β-hydroxyethyl, γ-acetoxypropyl, β-methoxyethyl, β-carboxyethyl, β-methoxycarbonylethyl, γ-ethoxycarbonylpropyl, β-sulfoethyl, γ-sulfopropyl, or δ-sulfobutyl), alkenyl group (for example, allyl), or aralkyl group (for example, benzyl or phenethyl); $R_3$ represents hydrogen or methyl; each $m$ and $n$ is 1 or 2; and $X^{\ominus}$ represents an acid anion (for example, methylsulfate ion, ethylsulfate ion, thiocyanate ion, p-toluenesulfonate ion, chloride ion, bromide ion, iodide ion, or perchlorate ion).

Typical examples of the dyes used in this invention are given below, but these examples are not limitative.

(A)

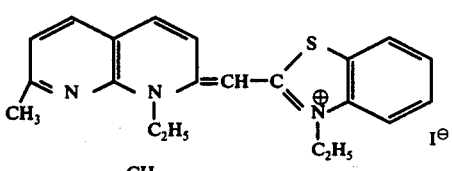

(B)

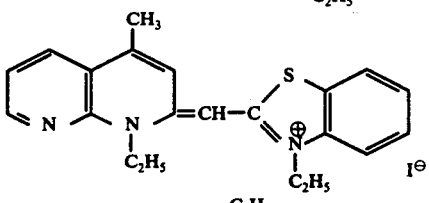

(C)

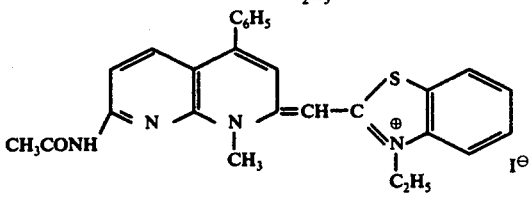

(D)

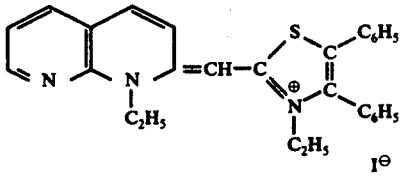

(E)

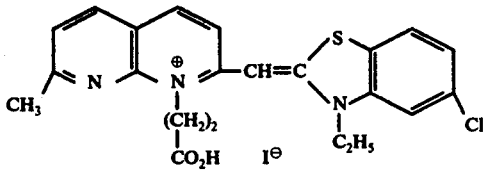

(F)

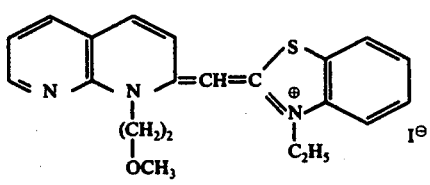

-continued (G)

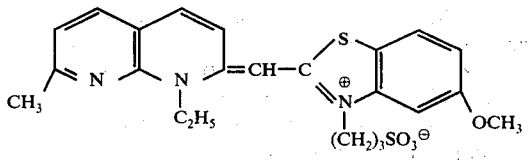

(H)

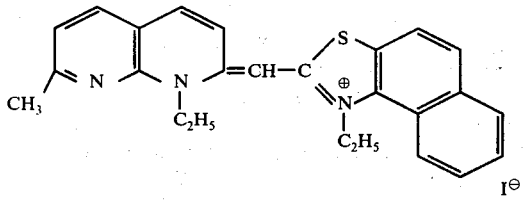

(I)

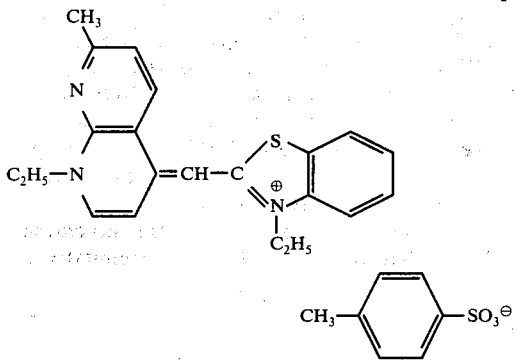

(J)

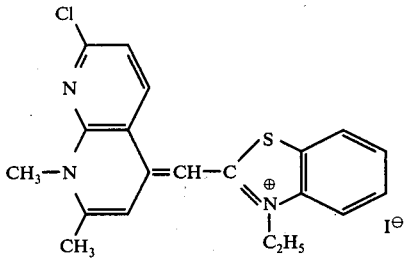

(K)

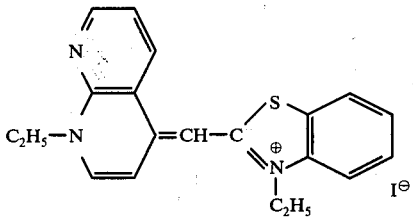

(L)

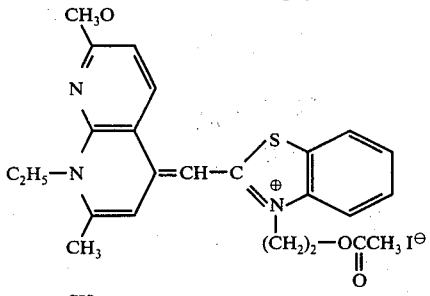

(M)

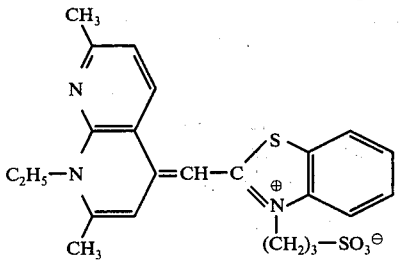

-continued (N)

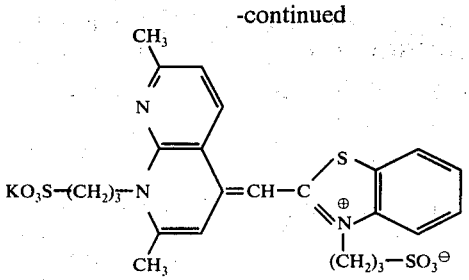

(O)

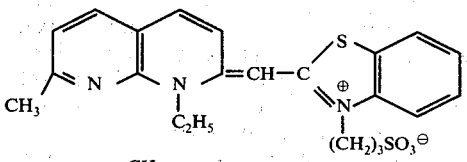

(P)

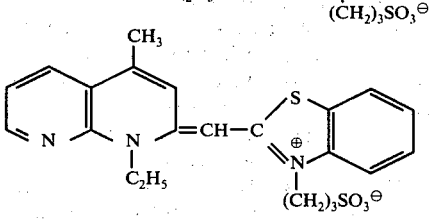

The cyanine dyes represented by the above general formula and used in this invention can be easily synthesized by widely known methods for producing cyanine dyes. An example of the synthesis of the dye (A) is given below.

0.32 Gram of 2,7-dimethyl-1,8-naphthyridine ["Yakugaku Zasshi" (Journal of Pharmaceutical Society, Japan), Vol. 94, 1328 (1974)] and 0.62 g of diethylsulfate are heated at a bath temperature of 100° to 110° C for 3 hours. After cooling, the reaction mixture is washed with ethyl ether. The resulting quaternary ammonium base is mixed with 0.82 g of 3-ethyl-2-ethylthiobenzothiazolium p-toluenesulfonate and the mixture is dissolved with heating in 10 ml of ethanol. To the resulting solution is added 0.40 g of triethylamine and the mixture is refluxed (with heating) for 30 minutes. After addition of a solution of 0.30 g of sodium iodide in 20 ml of ethanol, the mixture is cooled and filtered to collect the precipitated crude dyes. After recrystallization from methanol and subsequent drying, there is obtained 0.36 g of fine needle crystals, reddish brown in color, melting at 300° C (decomp.) and having absorption maxima at 493 and 473 nm in methanol.

Other cyanine dyes for use in this invention can also be easily synthesized by the procedure similar to that of the above example.

The silver halide emulsions according to this invention include emulsions of, for example, silver chloride, silver bromide, silver chlorobromide, silver chloroiodide, silver iodobromide, and silver chloroiodobromide. The grain size of these emulsions can be in the range common to customary emulsions, but most preferably results are obtained particularly when the average grain size is 0.5 μ or less. Although the silver halide emulsion according to this invention can be monodispersed or not monodispersed, the monodispersed emulsion is preferable. The "monodispersed emulsion," as herein referred to, is an emulsion prepared so as to contain at least 95% by weight of the photographic silver halide grains having the size which is within about 40%, preferably 30% of the average grain size, as described in, for example, U.S. Pat. No. 3,501,305. The silver halide grain of the present emulsion can have any crystal habit, but cubic grains are preferable. Although the silver halide grain of the present emulsion can be either regular or irregular, regular grain is preferable. The "regular grain," as herein referred to, is a grain having to twinning plane and, conversely, the "irregular grain" is a grain having the twinning plane, as described in, for example, U.S. Pat. No. 3,501,306. It is desirable to use an emulsion containing 80% by weight or more of regular grains.

The emulsion according to this invention may comprise silver halide grains having electron trapping site in the interior of the grains and fogged with a chemical fogging agent at the surface. Such a type of emulsion is readily subject to solarization and gives a direct-positive image preferably. It gives better results when spectrally sensitized. Methods for making these emulsions are described in, for example, U.S. Pat. Nos. 3,367,778, 3,632,340, and 3,709,689.

The silver halide emulsion according to this invention is fogged optically or with chemical fogging agents. Chemical fog speck are formed by various chemical sensitization methods. Desirable results are obtained particularly by the method described by Antoine Hautot and Henri Saubenier in Science et Industries Photographiques, Vol. 28, 57 - 65 (1957). In this invention the emulsion can be fogged also with reducing agents such as stannous chloride, thiourea dioxide, formalin, alkali arsenites, hydrazine derivatives, and amine boranes.

In this invention, the emulsion can be fogged also with a reducing agent jointly with a compound of a metal more electropositive than silver. Examples of such compounds according to this invention are gold compounds such as potassium chloroaurate, platinum compounds such as potassium platinate, and iridium compounds such as potassium hexachloroiridate.

Further, desirable fogging is also produced with the combination of above-noted fogging agents and a sulfur-containing sensitizer, for example sodium thiosulfate, or a thiocyanate compound, for example potassium thiocyanate.

It is desirable to incorporate an electron acceptor in the present direct-positive silver halide emulsion. An organic desensitizing dye known as an electron acceptor is generally defined as a compound which has the lowest vacant electronic energy level lower than the electronic energy level of the conduction band of silver halide grains. Further, it is desirable that the highest occupied electronic energy level of a desensitizing dye should be lower than the electronic energy level of the valence band of silver halide grains. It is well known that close relationships exist between these electronic levels and the anodic polarographic halfwave potential as well as the cathodic polarographic halfwave potential, as described, for example, by R. W. Berriman and P. B. Gilman, Jr. in Photographic Science and Engineering, Vol. 17, 235 - 244 (1973) and by L. Costa, F. Grum, and P. B. Gilman, Jr. in Photographic Science and Engineering, Vol. 18, 261 - 275 (1974).

Preferable organic desensitizing dyes for use in this invention have an anodic polarographic halfwave potential more positive than +1.0 volt and a cathodic polarographic halfwave potential less negative than −1.0 volt. Examples of such organic desensitizing dyes are described in U.S. Pats. Nos. 2,930,694, 3,367,779, 3,492,123, 3,501,309, 3,501,310, 3,528,811, 3,574,629, 3,579,344, 3,579,345, 3,582,348, 3,592,653, 3,598,595; British Pat. No. 1,192,384; Japanese Patent Publication No. 14,500/68. Other effective organic desensitizing dyes include those cyanine dyes and merocyanine dyes which contain at least one, preferably two desensitizing substituents such as nitro group.

Examples of individual desensitizing dyes for use in this invention are pinacryptol yellow, phenosafranin, methylene blue, capri blue, amethyst violet, 9-cyanopyrroline, pinacryptol green, crystal violet, 5-m-nitrobenzylidenerhodanine, 3-ethyl-5-m-nitrobenzylidenerhodanine, 3-ethyl-(2,4-dinitrobenzylidene)rhodanine, 5-o-nitrobenzylidene-3-phenylrhodanine, 1',3-diethyl-6-nitrothia-2'-cyanine iodide, 3,3'-diethyl-6,6'-dinitro-9-phenylthiacarbocyanine iodide, 4-nitro-6-chlorobenzotriazole, 3-ethyl-2-(p-dimethylaminophenylimino)benzothiazolium ethosulfate, 1,3-diamino-5-methylphenazinium chloride, 3,3'-di-p-nitrobenzylthiacarbocyanine bromide, 3,3'-di-o-nitrophenylthiacarbocyanine iodide, bis-(4,6-diphenylpyryl-2)trimethinecyanine perchlorate, and anhydro-2-p-dimethylaminophenyliminomethyl-6-nitro-3-(4-sulfobutyl)-benzothiazolium hydroxide.

Higher-speed direct-positive photographic silver halide emulsions may be obtained with the combination of the novel dyes according to this invention and other known cyanine dyes.

In the present emulsion, gelatin is generally used as the protective colloid. Also usable are photographically inactive gelatin derivatives and water-soluble synthetic polymers (for example, polyvinyl acrylate, copolymers of acrylamide and acrylic acid, polyvinyl alcohol, polyvinyl pyrrolidone, and polyvinyl alginate).

The present direct-positive photographic silver halide emulsion can contain various additives such as stabilizers for fog speck, whiteness increasing agents, ultraviolet absorbers, hardeners, surfactants, antiseptics, plasticizers, matting agents, color couplers, etc.

The amount to be added of the novel dye used in this invention is $1 \times 10^{-6}$ to $1 \times 10^{-2}$ mole, preferably $3 \times 10^{-5}$ to $5 \times 10^{-3}$ mole per mole of silver. The dyes are added as a solution in solvents such as, for example, water, methanol, ethanol, dimethylformamide, acetone, and pyridine. In making the solution, a dispersion technique employing ultrasonic vibration can be used. Although the addition of the dye can be carried out in any step of manufacturing the emulsion, it is conveniently done immediately before coating. The organic desensitizing dyes and known cyanine dyes are added in an amount and in a manner similar to those mentioned above.

The direct-positive photographic silver halide emulsion of this invention can be coated on various supports. Typical supports include cellulose acetate film, cellulose nitrate film, polyvinylacetal film, polystyrene film, polyethylene terephthalate film, other polyester films as well as glass, paper, metal , wood and the like. Paper laminated with plastics can also be used.

After exposure, the present direct-positive photographic silver halide emulsion is processed in baths for developing, fixing, bleaching, etc., each separately or in combinations.

The first feature of this invention is spectral sensitization of direct-positive photographic silver halide emulsions with novel dyes.

The second feature of this invention is no decreasing tendency of the maximum density in spite of the addition of the novel dyes to the present direct-positive photographic silver halide emulsion.

The third feature of this invention is no color stain due to the remains of the novel dyes used in the present emulsion after processing.

A high-speed direct-positve photographic silver halide emulsion can be obtained using the present novel dye jointly with an organic desensitizer. A still higher speed and high-contrast direct-positive photographic silver halide emulsion can be obtained with the combination of the present novel dye and other known cyanine dyes.

The direct-positive photographic silver halide emulsion according to this invention is useful in various application fields such as, for example, duplicating photosensitive material of lithographic film, direct-positive color photosensitive material, duplicating photosensitive material of microfilm, and duplicating photosensitive material of X-ray film.

The direct-positive photographic silver halide emulsion according to this invention is useful for exposure to not only light, but also electron beam, X-rays, and $\gamma$-rays.

The invention is illustrated below in detail with reference to Examples.

EXAMPLE 1

An aqueous silver nitrate solution and an aqueous solution of sodium bromide and sodium chloride were simultaneously added to an aqueous gelatin solution, while maintaining pAg constant, to prepare a silver chlorobromide emulsion containing about 20% of bromide. 0.01 mole/mole Ag of potassium iodide was added to the resulting emulsion. To the emulsion, after having been digested at 60° C for 5 minutes, was added gelatin followed by an aqueous sodium sulfate solution. The precipitate was washed, redissolved, admixed with thiourea dioxide and chloroauric acid, and digested for 2 hours. Each portion of the resulting emulsion was admixed, successively, with a methanol or aqueous solution containing a given amount of one of the dyes shown in Table 1, 300 mg/mole Ag of pinacryptol yellow, a hardener, and a surfactant. The final emulsion thus obtained was coated on cellulose triacetate film at a coverage of about 2.6 g of silver per square meter. After drying, the coated sample was exposed through an optical wedge with a density gradient of 0.15, then developed in Kodak D-72 developer at 20° C for 2 minutes, and fixed in an acidic hardening fixer bath. The resulting material was measured for optical density. The characteristic values obtained were as shown in Table 1, wherein $D_{max}$ and $D_{min}$ represent maximum optical density and minimum optical density, respectively; sensitivity S is a relative value corresponding to the reciprocal of the exposure which gives a density of ($D_{min}$ + 1.0); $\gamma$ is the inclination of the linear region between densities of 0.5 and 2.5.

Table 1

| Sample No. | Dye | Amount added (mg/mole Ag) | S | $\gamma$ | $D_{max}$ | $D_{min}$ | Spectrally sensitized region (nm) |
|---|---|---|---|---|---|---|---|
| 1 | none | — | 100 | 5.2 | 3.21 | .03 | — |
| 2 | A | 300 | 338 | 5.7 | 3.15 | .03 | 450 - 575 |
| 3 | B | 300 | 321 | 5.7 | 3.16 | .03 | 450 - 575 |
| 4 | C | 300 | 312 | 5.6 | 3.14 | .03 | 460 - 590 |
| 5 | D | 300 | 238 | 5.8 | 3.09 | .03 | 460 - 590 |
| 6 | E | 300 | 280 | 5.2 | 3.13 | .03 | 460 - 590 |
| 7 | F | 300 | 502 | 5.1 | 3.08 | .03 | 450 - 575 |
| 8 | G | 300 | 341 | 5.2 | 3.14 | .03 | 450 - 580 |
| 9 | A+G | 150+150 | 340 | 5.5 | 3.15 | .03 | 450 - 580 |

It can be seen from Table 1, that in using the novel dye according to this invention, a direct-positive silver halide emulsion has been sensitized by about 2 to 5 times. It is also seen that a direct-positive silver halide emulsion with clear image without color stain due to the residual dye has been obtained. As compared with a control, no significant decrease in $D_{max}$ was observed.

EXAMPLE 2

An aqueous silver nitrate solution and an aqueous solution containing potassium bromide and potassium iodide were simultaneously added to an aqueous gelatin solution, while maintaining pAg at a constant value, to prepare a silver iodobromide emulsion containing about 2% of iodine. To the emulsion was added gelatin followed by an aqueous solution of sodium sulfate. The precipitate was washed, redissolved, admixed with thiourea dioxide and chloroauric acid, and digested for 2 hours. Each portion of the resulting emulsion was admixed, successively, with a methanol or aqueous solution containing a given amount of one of the dyes shown in Table 2, 200 mg/mole Ag of pinacryptol yellow, a hardener, and a surfactant. The final emulsion thus obtained was coated on cellulose triacetate film at a coverage of about 2.6 g of silver per square meter. After drying, the coated sample was exposed through an optical wedge with a density gradient of 0.15, then developed in Kodak D-72 developer at 20° C for 2 minutes and fixed in an acidic hardening fixer bath. The resulting material was measured for optical density. The characteristic values obtained were as shown in Table 2.

Table 2

| Sample No. | Dye | Amount added (mg/mole Ag) | S | $\gamma$ | $D_{max}$ | $D_{min}$ | Spectrally sensitized region (nm) |
|---|---|---|---|---|---|---|---|
| 1 | none | — | 100 | 4.0 | 3.18 | .03 | — |
| 2 | H | 300 | 295 | 4.0 | 3.19 | .03 | 460 - 590 |
| 3 | I | 300 | 380 | 4.1 | 3.01 | .03 | 460 - 600 |
| 4 | J | 300 | 280 | 4.3 | 3.14 | .03 | 460 - 605 |
| 5 | K | 300 | 324 | 4.0 | 3.01 | .03 | 470 - 600 |
| 6 | L | 300 | 406 | 3.9 | 3.02 | .03 | 460 - 605 |
| 7 | M | 300 | 588 | 3.8 | 2.98 | .03 | 450 - 605 |
| 8 | N | 300 | 430 | 3.9 | 3.11 | .03 | 460 - 605 |
| 9 | O | 300 | 351 | 4.4 | 3.19 | .03 | 450 - 575 |
| 10 | P | 300 | 350 | 4.1 | 3.16 | .03 | 450 - 580 |

It can be seen from Table 2, that in using the novel dye according to this invention, a direct-positive silver halide emulsion has been sensitized by about 2 to 6 times. It is also seen that a direct-positive silver halide emulsion with clear image without color stain due to the residual dye has been obtained. As compared with a control, no significant decrease in $D_{max}$ was observed.

EXAMPLE 3

A fogged emulsion was prepared in the same manner as in Example 2. A direct-positive silver halide emulsion was prepared and processed in the same manner as in Example 1, except that a methanol solution containing 300 mg/mole Ag of the dye (I) and 300 mg/mole Ag of 1',3-diethylthia-2'-cyanine iodide was added. On sensitometry, the following characteristic values were obtained: S = 1,078, $\gamma$ = 4.2, $D_{max}$ = 3.01, $D_{min}$ = 0.03. It is seen that the sensitivity of this sample has been increased by about 3 times as compared with the sample obtained by using the dye (I) alone.

What is claimed is:

1. A direct-positive photographic fogged silver halide emulsion characterized by containing at least one cyanine dye in which the position 2 or 4 of a 1,8-naphthyridine ring is joined through the position 2 of a thiazole ring through a methine linkage, said dye being present in an amount sufficient to sensitize said emulsion.

2. A direct-positive photographic silver halide emulsion according to claim 1, wherein the cyanine dye is represented by the formula (A) or (G):

(A)

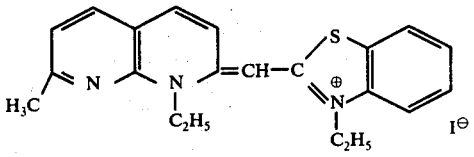

(G)

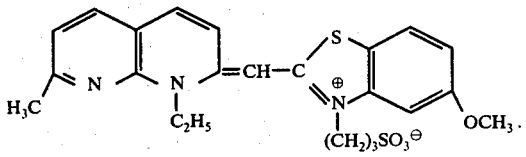

3. A direct-positive photographic silver halide emulsion according to claim 1, wherein the amount to be added of the cyanine dye is $1 \times 10^{-6}$ to $1 \times 10^{-2}$ mole per mole of silver.

4. A photographic element comprising a support and at least one direct positive photographic fogged silver halide emulsion layer which contains at least one cyanine dye in which the position 2 or 4 of a 1,8-naphthyridine ring is joined through the position 2 of a thiazole ring through a methine linkage, said dye being present in an amount sufficient to sensitize said emulsion.

5. A photographic element according to claim 4, wherein the cyanine dye is represented by the formula (A) or (G):

(A)

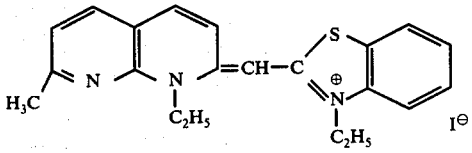

(G)

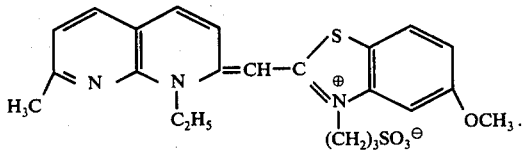

6. A photographic element according to claim 4, wherein the amount to be added of the cyanine dye is $1 \times 10^{-6}$ to $1 \times 10^{-2}$ mole per mole of silver.

7. A direct-positive photographic silver halide emulsion according to claim 1, wherein the cyanine dye is represented by the general formula

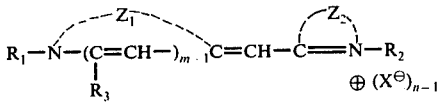

wherein each $R_1$ and $R_2$ represents a substituted or unsubstituted lower alkyl group, alkenyl group, or aralkyl group; $R_3$ represents hydrogen or methyl; $Z_1$ represents a nonmetallic atom or a group of nonmetallic atoms necessary for completing a 1,8-naphthyridine ring or such a ring having a substituent group selected from the group consisting of lower alkyl, lower alkoxy, acylamido, aryl, and halogens; $Z_2$ represents a group of nonmetallic atoms necessary for completing a thiazole ring, benzothiazole ring, or naphthothiazole ring and such thiazole ring or benzene ring condensed with thiazole ring having a substituent group selected from the group consisting of lower alkyl, aryl, hydroxyl, lower alkoxy, carboxyl, alkoxycarbonyl, nitro, and halogen atoms; each $m$ and $n$ is 1 or 2; and $X^{\ominus}$ represents an acid anion.

8. A photographic element according to claim 4, wherein the cyanine dye is represented by the general formula

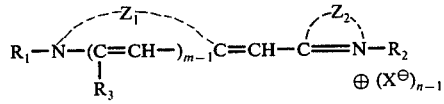

wherein each $R_1$ and $R_2$ represents a substituted or unsubstituted lower alkyl group, alkenyl group, or aralkyl group; $R_3$ represents hydrogen or methyl; $Z_1$ represents a nonmetallic atom or a group of nonmetallic atoms necessary for completing a 1,8-naphthyridine ring or such a ring having a substituent group selected from the group consisting of lower alkyl, lower alkoxy, acylamido, aryl, and halogens; $Z_2$ represents a group of nonmetallic atoms necessary for completing a thiazole ring, benzothiazole ring, or naphthothiazole ring and such thiazole ring or benzene ring condensed with a thiazole ring having a substituent group selected from the group consisting of lower alkyl, aryl, hydroxyl, lower alkoxy, carboxyl, alkoxycarbonyl, nitro, and halogen atoms; each $m$ and $n$ is 1 or 2; and $X^{\ominus}$ represents an acid anion.

* * * * *